US006475008B1

(12) United States Patent
Marolda et al.

(10) Patent No.: US 6,475,008 B1
(45) Date of Patent: Nov. 5, 2002

(54) UNDERWATER MATEABLE ELECTRICAL CONNECTOR WITH ANTI-HYDROLOCK FEATURE

(75) Inventors: Victor J. Marolda, Salem; Roy R. Manstan, East Haddam, both of CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1072 days.

(21) Appl. No.: 08/682,878

(22) Filed: Jun. 24, 1996

(51) Int. Cl.[7] ..... H01R 13/52
(52) U.S. Cl. ..... 439/271; 439/277
(58) Field of Search ..... 439/271, 272, 439/277, 936

(56) References Cited

U.S. PATENT DOCUMENTS 4,540,230 A * 9/1985 Iverson et al. ..... 439/277
4,723,230 A * 2/1988 Chelminski ..... 439/272
4,909,751 A * 3/1990 Marolda, Jr. ..... 439/273

* cited by examiner

*Primary Examiner*—Tho D. Ta
(74) *Attorney, Agent, or Firm*—Michael J. McGowan; Prithvi C. Lall; Michael F. Oglo

(57) ABSTRACT

An electrical connector includes a plug section having a body, and a receptacle section which is connected to the plug section. A collapsible seal is disposed within a circumferential groove formed in the plug section. The receptacle section has a cylindrical housing with a clamping ring for securely engaging and connecting the receptacle section to the plug section. Upon connecting the receptacle section to the plug section any hydrostatic forces present in the chamber between the receptacle section and the plug section causes the collapsible seal to collapse within the groove thereby providing a volume defined by the groove which receives fluid therein for preventing hydrostatic lock.

9 Claims, 4 Drawing Sheets

UNDERWATER MATEABLE ELECTRICAL CONNECTOR WITH ANTI-HYDROLOCK FEATURE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates generally to waterproof electrical connectors, and more particularly to a means for achieving full electrical connection between corresponding plug and receptacle sections without hydraulic lock occurring between the sections when sealably connecting the two sections together.

(2) Description of the Prior Art

It is well-known that many types of electrical connectors are attached to equipment which are deployed underwater such as sonar systems and the like. Such equipment requires repair or routine maintenance from time to time. This repair or maintenance, however, necessitates removal of the equipment from the submerged location and therefor concomitant disconnection of all electrical connectors attached thereto. on occasion connector seals have failed, the connectors by themselves have flooded and then shorted, requiring replacement or refurbishment. In order to then reconnect the removed equipment or repair the connectors, the installation location must somehow be made dry or else one of the present, commercially available, underwater (UW) mateable type electrical connectors must have been used to make the connection. These present underwater mateable connectors, however, are well-known to be bulky, expensive and generally not available in sufficient quantity. Further, when intended for submarine sonar use, present UW mateable connectors are also of limited value due to their not having been designed to meet exacting military specifications.

A solution to the foregoing problems identified above can be found in U.S. Pat. No. 4,909,751 to Marolda. In this patent, there is disclosed a connector having a plug and a receptacle with an elastomeric electrical isolation membrane positioned therebetween for assisting in completing the electrical isolation of the connection under water. By employing the isolation membrane, the original O-ring was removed and the isolation disk made the connector suitable for underwater use.

One problem associated with this connector, however, is that the removal of the O-ring allowed free flooding of the plug and receptacle cavities. By removing the O-ring, the connector is exposed to internal ambient pressure since the O-ring seals the plug and receptacle of the connector so as to prevent this internal ambient pressure. The O-ring also seals the connector before a sufficient amount of water is pushed out of the plug and receptacle cavities. This results in-undesirable hydraulic lock ("hydrolock") which prevents an electrical isolation of the connectors since the plug and receptacle are not fully sealed.

SUMMARY OF THE INVENTION

Accordingly, it is a general purpose and object of the present invention to provide a means for permitting electrical connectors to be mated under water such that full electrical isolation is established without hydrolock occurring between the plug and receptacle of the connector.

It is further object that such electrical isolation means be useable in combination with existing, dry-assembly type, underwater electrical connectors.

Another object is that such electrical isolation means be producible at low cost.

Still another object is that such electrical isolation means exhibit dielectric properties while having a high degree of hydrolytic stability.

These objects are accomplished with the present invention by providing an electrical connector comprising a plug section having a body, and a receptacle section adapted to be connected to the plug section. The plug and receptacle sections are formed such that one the sections has a cylindrical extension extending beyond the face and the other section has an annular flange disposed radially outwardly with respect to said cylindrical extension. A circumferential groove formed in a selected one of the plug section and receptacle section, and a. collapsible seal is disposed within the groove. The arrangement is such that upon sealingly connecting the receptacle section to the plug section, any hydrostatic forces present in the chamber between the receptacle section and the plug section causes the collapsible seal to collapse within the groove thereby providing a volume defined by the groove which receives fluid therein for preventing hydrostatic lock.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals designate identical or corresponding parts throughout the several views and wherein.

DESCRIPTION OF THE PREFERRED EMBODIMENT

Figure 1:
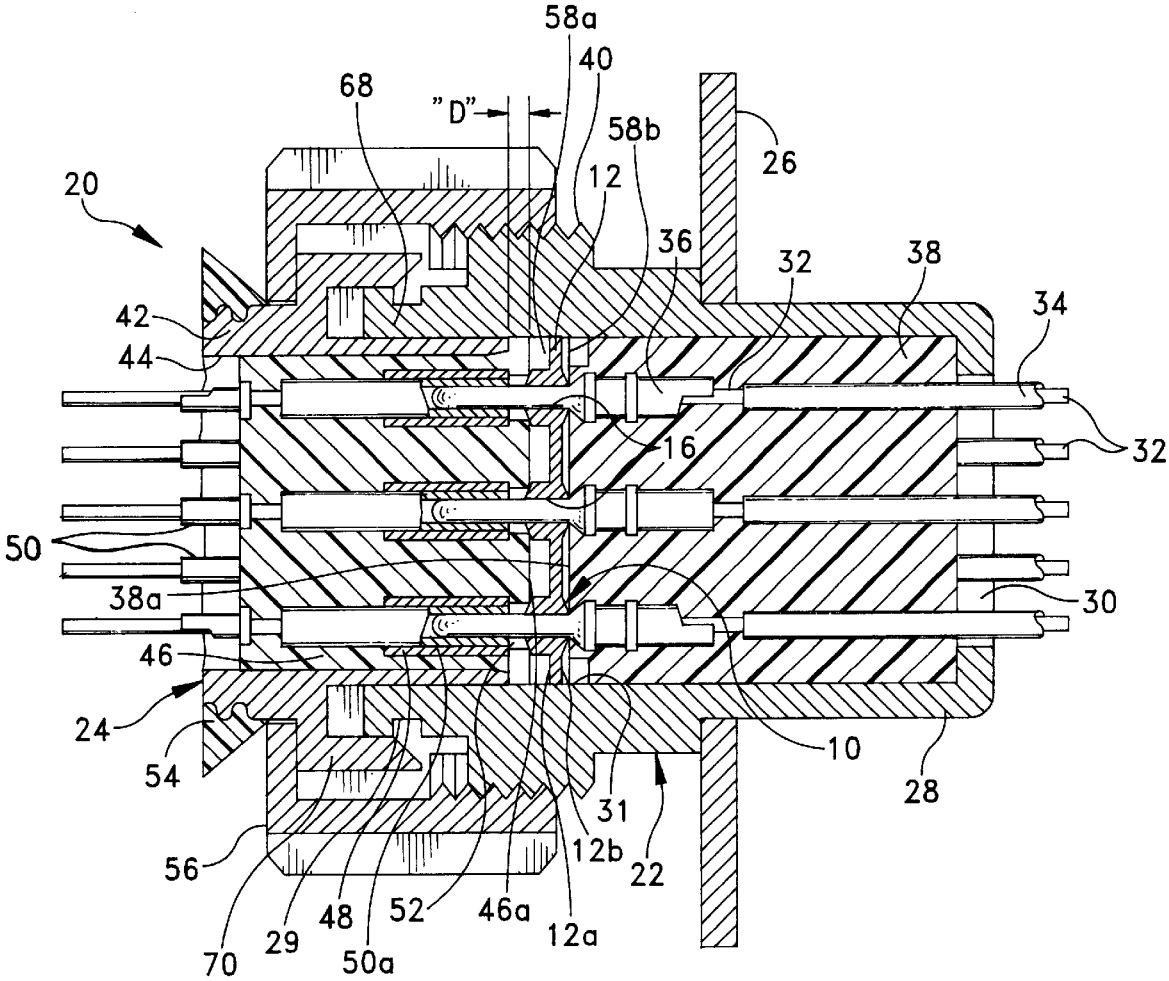
FIG. 1 (Prior Art)
FIG. 1 is a cross-sectional view of an electrical connector according to the present invention.
Figure 2:
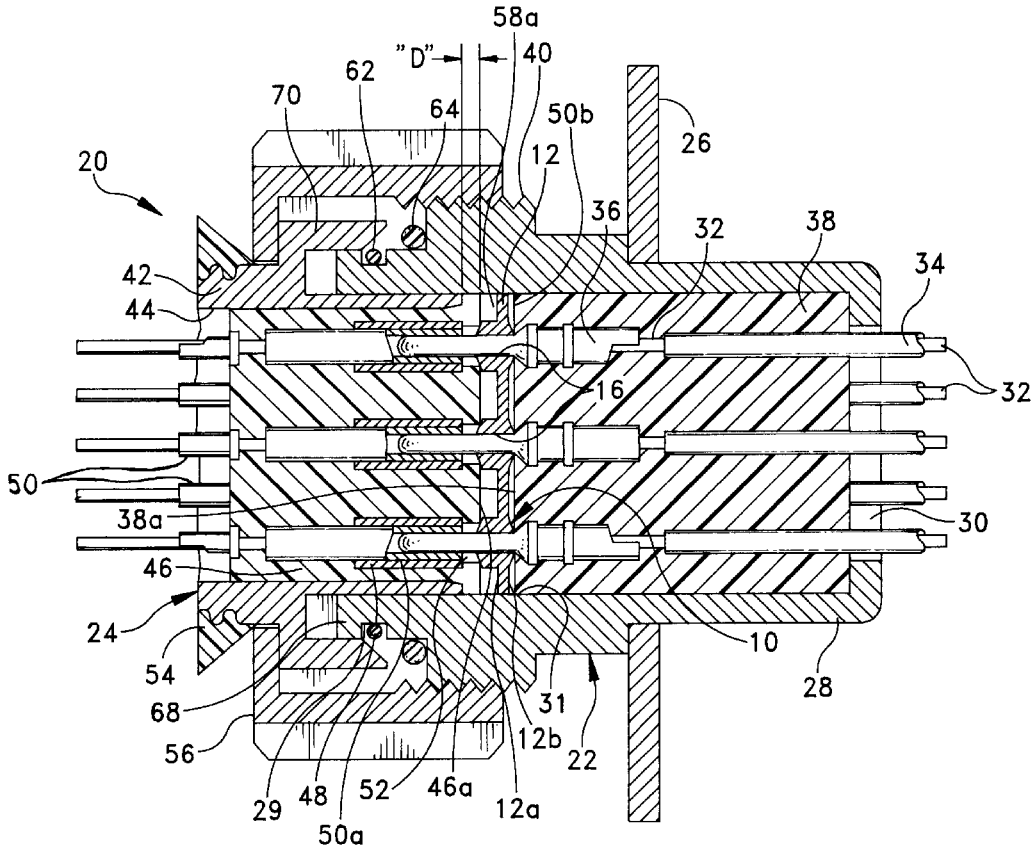
FIG. 2 shows a cross-sectional view of the connector of FIG. 1 illustrating seals of the present invention located in grooves formed in a body section of the connector.
Figure 2A:
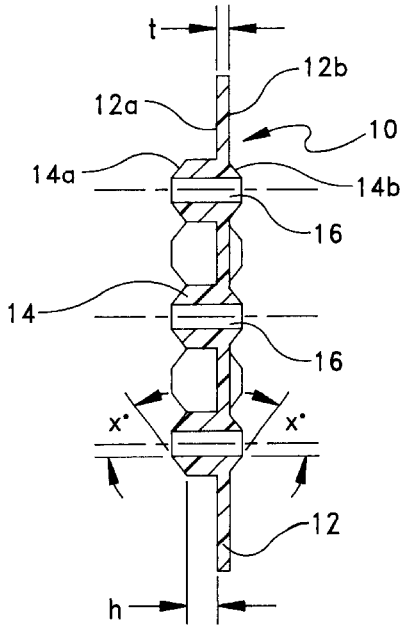
FIG. 2A (Prior Art)
FIG. 2A is an enlarged cross-sectional view of an electrical isolation device of the connector.

Referring now to FIGS. 1, 2 and 2A, and more particularly to FIG. 2A, there is shown an electrical isolation device generally indicated at 10 comprising a thin circular membranous elastomeric disk 12. Disk 12 connects a plurality of protruding cylindrical elastomeric embossments 14 which form apertures 16 (see FIG. 2A). The shape, quantity, spacing and pattern of embossments 14 are selected based on the pin configuration of an electrical connector that device 10 will be used in conjunction therewith. Membrane 12 maintains the selected alignment of embossments 14. Device 10 is formed by molding a dielectric elastomeric material selected to have good hydrolytic stability, i.e., resistance to hydrolysis effects, into the desired shape. The preferred embodiment uses a neoprene rubber of Shore durometer 45-50 but any other dielectric elastomer which is hydrolytically stable may be substituted without deviating from the teachings of the present invention.

FIG. 2A shows a cross-sectional view of the electrical isolation device 10 of FIGS. 1 and 2. Disk 12 is of thickness "t" which in the preferred embodiment is 0.030–0.35 inches thick. Disk 12 further comprises a first side 12*a* and a second side 12*b*. Each cylindrical embossment 14 further has a first protruding end 14*a* on side 12*a*, a second protruding end 14*b* on side 12*b* and a longitudinal center line parallel to all other embossment 14 center lines. Each protruding end 14*a* and 14*b* has formed thereon a conical taper of angle "x", which angle is preselected to contact the pin socket recesses of the connector it will be used in conjunction therewith. In the preferred embodiment, angle "x" is selected to be 60 degrees. In addition, first protruding end 14*a* has a cylindrical extension of height "h" where "h" may be selected to be zero or greater.

FIG. 1 illustrates electrical isolation device 10 used in combination with a typical, open face pressure tolerant, dry-assembly type electrical connector generally indicated at 20 such as a MIL-C-2431 which, according to the teachings of Patent 4,909,751, along with removal of an O-ring, is converted into an underwater mateable connector. This provides electrical isolation between pins which do not physically touch each other. Connector 20 further comprises a male plug section generally indicated at 22 and a female receptacle section generally indicated at 24. Plug section 22 is shown fixedly mounted through a wall or hull 26 but may also be used as part of a free standing coupling system. Plug section 22 further comprises a cylindrical metal body 28 having a groove 29 at one end thereof, which, under normal circumstances, receives an O-ring, and a circular aperture 30 at its other end sized slightly smaller than deep bore 31 which passes almost therethrough.

A plurality of electrical wires 32 from a cable, wire harness or the like pass through aperture 30 at the cable end of body 28 of the plug section 22 and into the internal bore 31 cavity, each wire being covered with insulation 34. Within body 28, each wire 32 conductively attaches to a corresponding pin 36. Plug pins 36 are arranged in a preselected pattern parallel to each other but not in physical contact. Wires 32 and plug pins 36 are, except for a portion of each pin opposite the wire end, embedded in a cylindrical elastomer block 38 which fills the remaining volume inside the body 28 cavity formed by bore 31 and provides open face 38*a* pressure tolerance for plug section 22. This leaves a portion of each pin extending beyond face 38*a* at the end of body 28 opposite the cable attachment end, hereafter called the pin end. The exterior of metal body 28 has disposed thereabout a threaded section 40 on the extending pin end.

Receptacle section 24 of connector 20 further comprises a generally cylindrical metal body or housing 42 having an aperture 44 of a preselected inner diameter formed therethrough. Aperture 44 has a cylindrical elastomeric receptacle block 46 in contact therewith, block 46 further comprising a face 46*a* and a plurality of metal sleeves 48 embedded therein at the face 46*a* end thereof, extending to within a preselected distance "D" of face 46*a*. Sleeves 48 are disposed in a pattern corresponding to plug pin 36 pattern of plug section 22. A plurality of metal receptacle pins 50, one each corresponding to one plug pin 36, are disposed in parallel through block 46, each of pins 50 having hollows ends 50*a* which extend through sleeves 48 flush with the sleeve 48 end nearest to surface 46*a* of block 46 which is in turn nearest to plug section 22. Block 46 is formed around receptacle pins 50 providing open face pressure tolerance for face 46*a*. A corresponding plurality of cylindrical apertures 52 in block 46 align with each hollow end 50*a* and sleeve 48, each aperture 52 being slightly larger in diameter than the outside diameter of the corresponding hollow end 50*a* and extending a preselected depth "D" in from surface 46*a* of block 46. Each receptacle pin end opposite hollow end 50*a* is conductively connected to an attached cable means and potted with an elastomeric material 54. A threaded clamping ring 56 is provided over body 42 having a thread disposed within which mates with thread 40 of body 28. Threaded clamping ring 56 provides a connecting means for securely engaging and connecting plug section 22 to receptacle section 24.

In accordance with the teachings of the '751 Patent, when the device 10 is used in conjunction with conventional electrical connectors, such as connector 20, the original O-rings are removed from the groove 29. This allows free flooding of the plug and receptacle cavities between faces 38*a* and 46*a*. In operation, the absence of an occlusive seal prevents hydrostatic pressures from being built-up early in the receptacle-plug engagement phase. It also reduces the possibility of cable hosing (i.e., flooding), corrosion and low resistance failure due to pressure built-up while clamping. Thus, before the connector 20 of the present invention, sides 12*a* and 12*b*, and apertures 16 of device 10 are lubricated all over with commercially available underwater dielectric grease, shown generally as 58*a* and 58*b* respectively, such as a Dow Corning Corp. MIL-S-8660-C Silicon Compound or the like. Apertures 16 of electrical isolation device 10 are then slipped over the plurality of male plug pins 36 with grease 58*b* coming into contact with face 38*a*. Female receptacle section 24 is engaged plug pin 36 to receptacle pin 50 and tightening is started. As the conical ends of embossments 14*a* come in contact with the bottom of the respective apertures 52, a cleansing and purging of dielectric grease and water begins at face 46*a*. The grease-water mixture is pushed from the male pin 36 up along the conical surface 14*a* and out of the female cavity 52. When the cavity is completely filled by embossment 14*a* and tightening is continued, grease covered sides 12*a* and 12*b*come in contact with faces 46*a* and 38*a* respectively at which point hydrostatic pressure causes most grease and water to be squeezed out and once tightening is complete and remaining water is broken up into a discontinuous series of microspheres. Grease 58*a* first comes in contact with face 46*a* and then-as further tightening occurs sides 12*a* and 12*b* of membrane 12 also came into contact with faces 46*a* and 38*a* respectively, thereby completing electrical isolation for the connector.

However, under most circumstances, it is desirable to provide an occlusive seal between the plug section 22 and receptacle section 24, but the likelihood of hydrolock between these two members prevents the inclusion of such a seal. The present invention addresses this problem.

Figure 3A:
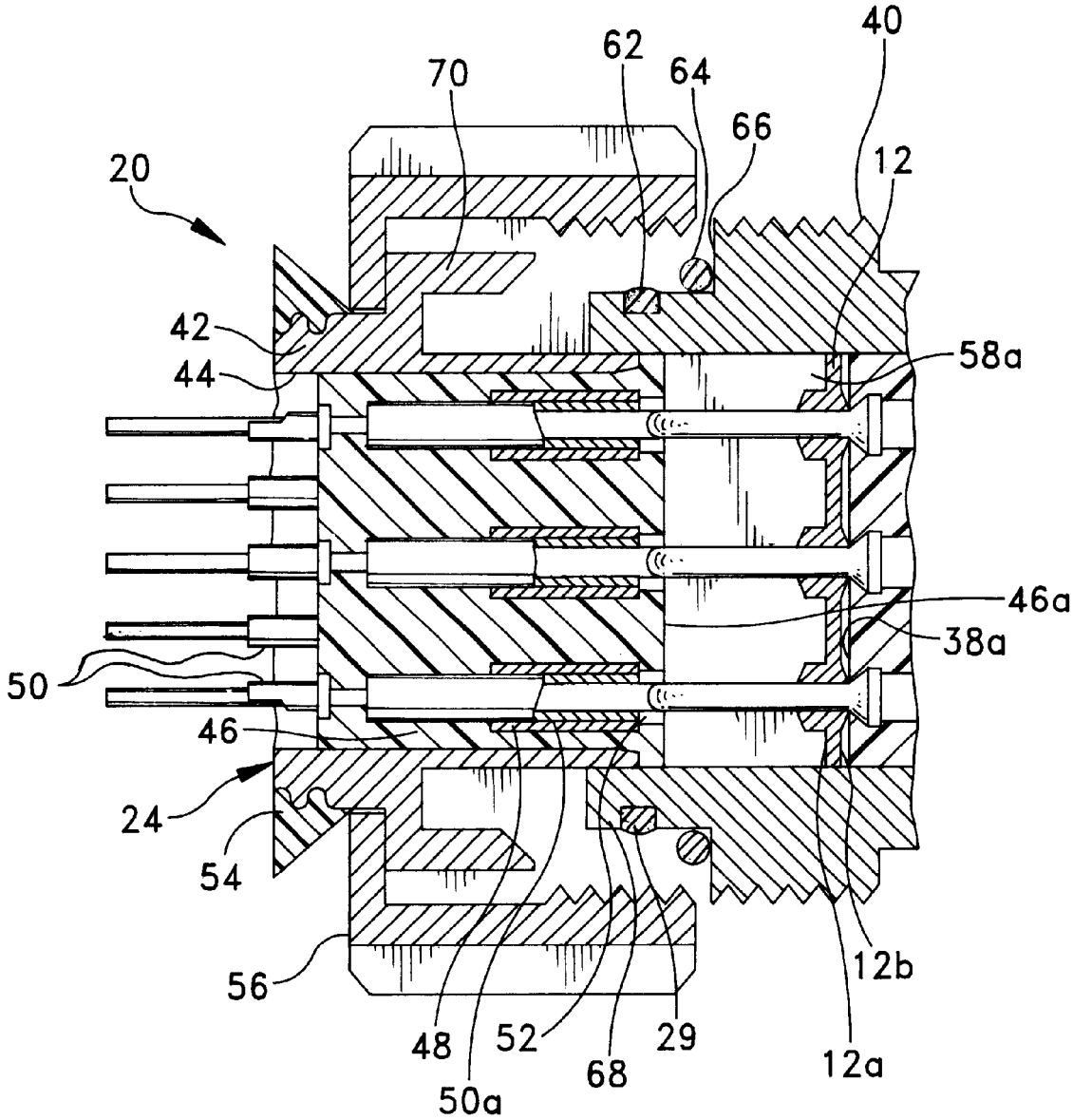
FIG. 3A is a schematic view of the connector illustrating an O-ring type seal which seals a plug section and receptacle section of the connector and a collapsible seal of the present invention, the plug section and receptacle section being in a non-sealed, spaced apart position.

Referring to FIGS. 2 and 3A–3C, and more particularly to FIG. 3A, the present invention is directed to placing a collapsible seal 62 in the groove 29 of the plug section 22, and an O-ring 64 between the mating portions of the plug section and the receptacle section 24. The collapsible seal 62 preferably has square-shaped cross-section area. As shown in FIG. 3A, the collapsible seal 62 completely fills or occupies the entire volume-of groove 29. With this configuration, the O-ring seal 64 can be disposed at the shoulder 66 formed between the threads 40 and an extension 68 of the plug section 22.

Figure 3B:
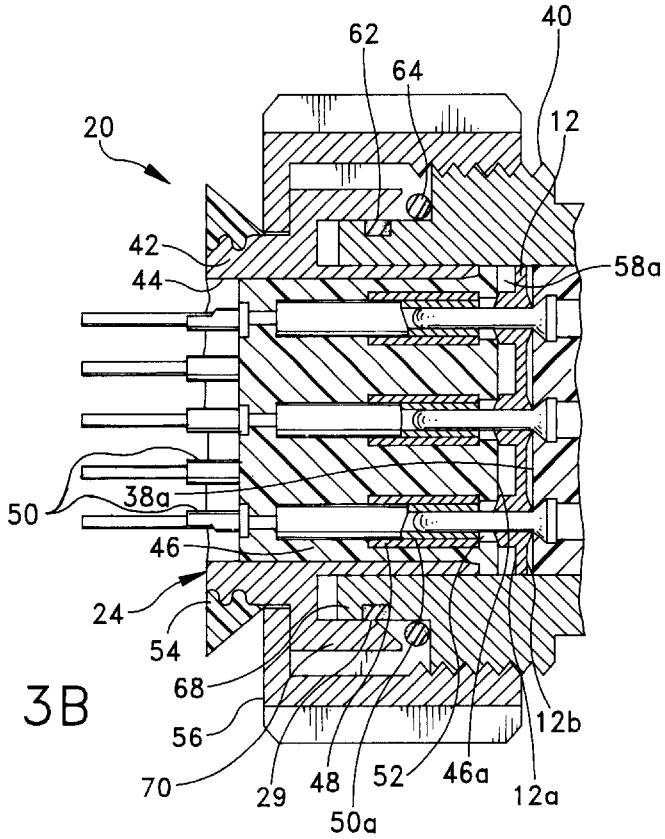
FIG. 3B is a view similar to, FIG. 3A illustrating the plug section and receptacle section in a partially sealed position.

FIG. 3B illustrates the plug section 22 being brought into threaded engagement with the receptacle section 24. As shown, an inner, annular flange 70 of the receptacle section is disposed radially outwardly with respect to the extension 68 of the plug section 22 so that it overlies or covers the groove 29 as the receptacle section and-plug section are tightened. Preferably, the end of the flange 70 is chamfered, as shown, so as to provide clean engagement between the flange and the O-ring seal 64 when fully tightening the plug and receptacle sections 22, 24.

Figure 3C:
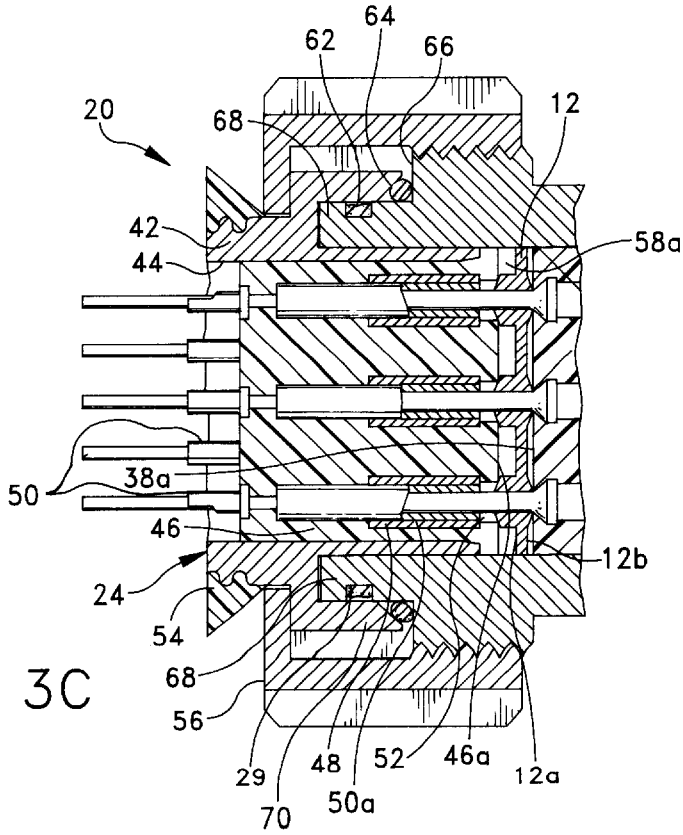
FIG. 3C is a view similar to FIGS. 3A and 3B illustrating the plug section and the receptacle section in a fully engaged and sealed position.

FIG. 3C illustrates the plug section 22 and receptacle section in a fully engaged position. The arrangement is such that at the very moment that the plug section 22 makes full engagement with the receptacle section 24, also known as "seating", the O-ring seal 64 is engaged thereby sealing the plug and receptacle sections 22, 24 of connector 20. Once fully engaged, clamping ring 56 provides a means for securely engaging the plug and receptacle sections 22, 24 thereby maintaining the seal created when O-ring seal 64 is engaged.

Once the connector 20 is sealed by the O-ring 64, the remaining water is displaced by the seating motion, and under normal circumstances, can cause hydrolock to occur. With the connector 20 of the present invention, the resulting pressure from the seating motion causes the collapsible-seal 62 to collapse, thereby providing a holding volume in groove 60 for the water to enter so as to prevent hydrolock and subsequent pressure increase in the volume defined by the plug section 22 and receptacle section 24. It should be understood that the groove 29 can be formed either the body 28 of the plug section 22 or the body 42 of the receptacle section 24 and still fall within the scope of the present invention. However, it is important that the groove 29 is located inside the O-ring seal 64 to provide room for the water that is trapped in the connector 20 when the O-ring seal becomes seated.

Thus, final tightening and completion of the plug-receptacle sealed engagement can be performed. Hydraulic lock is prevented while providing a means to seal the connector 20 from extreme pressure cycling. To reiterate, FIG. 3A illustrates the plug section 22 and receptacle section 24 in a pre-sealed configuration with the collapsible seal 62 being shown in its expanded configuration. FIG. 3B illustrates the plug section 22 and receptacle section 24 in their partially sealed configuration with the collapsible seal 62 being covered by the flange 70 of the receptacle section. FIG. 3C illustrates the plug section 22 and the receptacle section in their fully engaged position in which the seal 62 is collapsed to provide the requisite volume in groove 29 for excess sea water to enter so that the seal may be completed. The arrangement is such that upon threadably connecting the receptacle section 24 to the plug section 22, any hydrostatic forces present in the chamber between the receptacle section and the plug section causes the collapsible seal 62 to collapse thereby providing a volume defined by groove 29 which receives fluid therein for preventing hydrostatic lock.

It should be noted that the connector 20 of the present invention with its anti-hydrolock feature prevents hydrolock from occurring and prevents the connector 20 from being further exposed to extreme depth pressure cycling.

Obviously many modifications and variations of the present invention may become apparent in light of the above teachings. For example, the plug and receptacle sections can be formed such that the cylindrical extension 68 extends beyond the face of the receptacle section and annular flange 70 is attached to the plug section. Similarly, the clamping ring 56 can be any one of several conventional connection means for securely engaging and connecting the plug section to the receptacle section.

The advantages of the present invention over the prior art are that standard inexpensive electrical connectors can be easily adapted to underwater use and be reconnected in place without removal or dry-docking needed for the systems to which they attach.

In light of the above, it is therefore understood that within the scope of the appended claims, the invention may be practiced otherwise than as specifically described.

What is claimed is:

1. An electrical connector comprising:

a plug section having a plug face end and a plurality of electrically conductive pins protruding beyond the plug face end, said pins being disposed in a preselected pin pattern;

a receptacle section adapted to be connected to said plug section, said receptacle section having a receptacle face end and a plurality of metal sleeves for receiving said plurality of conductive pins, said plurality of metal sleeves being embedded at the receptacle face end and being disposed in a pattern corresponding to said preselected pin pattern;

a cylindrical extension affixed to and extending beyond the face end of a selected one of the plug section and receptacle section;

an annular flange attached to a selected one of the plug section and receptacle section, said annular flange being disposed radially outwardly with respect to said cylindrical extension;

a collapsible seal disposed within a circumferential groove formed in a selected one of the plug section and receptacle section, said circumferential groove defining a volume, said collapsible seal occupying the entire volume of the circumferential groove in a non-collapsed condition and occupying a portion of the circumferential groove in a collapsed condition; and an O-ring seal disposed between said plug section and said receptacle section.

2. The electrical connector of claim 1 further comprising electrical isolation means, disposed between said plug section and said receptacle section, for providing dielectric insulation between adjacent ones of said plurality of conductive pins.

3. The electrical connector of claim 2 further comprising a cylindrical connection collar, disposed over a selected one of said plug section and receptacle section, for securely engaging said plug section with said receptacle section.

4. The electrical connector of claim 3 wherein said electrical isolation means comprises a dielectric elastomer membrane having a plurality of dielectric cylindrical elastomeric embossments fixedly attached to said membrane, said embossments being disposed in a pattern that matches said preselected pin pattern.

5. The electrical connector of claim 4 wherein said electrical isolation means further comprises a dielectric grease applied over all surfaces of said dielectric elastomer membrane.

6. The electrical connector of claim 5 further comprising a cylindrical connection collar, disposed over a selected one of said plug section and receptacle section, for securely engaging said plug section with said receptacle section.

7. The electrical connector of claim 4 wherein said plurality of metal sleeves embedded at the receptacle face end are positioned so as to create a recess depth "D" from said receptacle face end.

8. The electrical connector of claim 7 wherein said electrical isolation means further comprises a dielectric grease applied over all surfaces of said dielectric elastomer membrane.

9. The electrical connector of claim 8 further comprising a cylindrical connection collar, disposed over a selected one of said plug section and receptacle section, for securely engaging said plug section with said receptacle section.

* * * * *